US008879752B2

(12) United States Patent
Harano et al.

(10) Patent No.: US 8,879,752 B2
(45) Date of Patent: Nov. 4, 2014

(54) MICROPHONE

(75) Inventors: Hiroyuki Harano, Fukuoka (JP); Hiroshi Yamagata, Fukuoka (JP); Kazuo Ono, Fukuoka (JP); Kensuke Nakanishi, Fukuoka (JP)

(73) Assignee: Hosiden Corporation, Osaka (JP)

( * ) Notice: Subject to any disclaimer, the term of this patent is extended or adjusted under 35 U.S.C. 154(b) by 207 days.

(21) Appl. No.: 13/583,474

(22) PCT Filed: Mar. 10, 2011

(86) PCT No.: PCT/JP2011/055644

§ 371 (c)(1),
(2), (4) Date: Sep. 7, 2012

(87) PCT Pub. No.: WO2011/125409

PCT Pub. Date: Oct. 13, 2011

(65) Prior Publication Data

US 2013/0010981 A1 Jan. 10, 2013

(30) Foreign Application Priority Data

Apr. 6, 2010 (JP) ..... 2010-087479

(51) Int. Cl.
*H04R 3/00* (2006.01)
*H04R 19/01* (2006.01)

(52) U.S. Cl.
CPC ..... *H04R 19/016* (2013.01)
USPC ..... 381/113; 381/94.1

(58) Field of Classification Search
CPC ..... H04R 1/04; H04R 3/00; H04R 3/005; H04R 19/04; H04R 19/016; H04R 2410/07; G10L 21/0208; G10L 2021/02165; G11B 20/24
USPC ..... 381/113, 94.1
See application file for complete search history.

(56) References Cited

U.S. PATENT DOCUMENTS 5,679,897 A * 10/1997 Matsumoto et al. ..... 73/514.34
6,404,896 B1 * 6/2002 Yoo et al. ..... 381/401
7,130,434 B1 * 10/2006 Grattan et al. ..... 381/113

(Continued)

FOREIGN PATENT DOCUMENTS

CN 101321406 12/2008
EP 1959711 8/2008

(Continued)

OTHER PUBLICATIONS

Extended European Search Report, mailed Oct. 22, 2013 from European Patent Office (E.P.O.) for the corresponding International Application.

(Continued)

*Primary Examiner* — Simon Sing
(74) *Attorney, Agent, or Firm* — Greenblum & Bernstein, P.L.C.

(57) ABSTRACT

A microphone capable of canceling vibration noise caused by mechanical vibration is provided with, in capsules, a pair of diaphragms and a pair of back plates opposite to the respective diaphragms. A printed circuit board is disposed at the middle of capsules. A pair of diaphragms is disposed close and opposite to the surfaces of the printed circuit board with the printed circuit board disposed therebetween. The difference in distance from a vibration source to the two diaphragms is made small. The microphone has a high canceling effect for canceling vibration noise caused by mechanical vibration.

16 Claims, 9 Drawing Sheets

(56) References Cited

U.S. PATENT DOCUMENTS

| | | | | |
|---|---|---|---|---|
| 7,224,812 | B2 * | 5/2007 | Chang | 381/174 |
| 7,260,230 | B2 * | 8/2007 | Feng | 381/174 |
| 7,630,506 | B2 * | 12/2009 | Akino | 381/174 |
| 7,903,829 | B2 * | 3/2011 | Kubota | 381/174 |
| 8,509,459 | B1 * | 8/2013 | Isvan | 381/113 |
| 8,705,775 | B2 * | 4/2014 | Sheplak et al. | 381/174 |
| 2008/0192962 | A1 | 8/2008 | Halteren | |
| 2008/0318640 | A1 * | 12/2008 | Takano et al. | 455/569.1 |
| 2009/0245544 | A1 * | 10/2009 | Horng et al. | 381/176 |

FOREIGN PATENT DOCUMENTS

| | | |
|---|---|---|
| JP | 02-041099 | 2/1990 |
| JP | 2005-354581 | 12/2005 |
| JP | 2006-140740 | 6/2006 |
| JP | 2007-174165 | 7/2007 |
| JP | 2007-306216 | 11/2007 |
| JP | 2008-199227 | 8/2008 |

OTHER PUBLICATIONS

International Search Report, dated Jun. 14, 2011, for corresponding International Application No. PCT/JP2011/055644.

Japan Office Action, mailed Nov. 5, 2013, in corresponding Japanese Patent Application No. 2010-087479 (together with English language translation).

China Office Action, mailed Jun. 3, 2014, in corresponding Chinese Patent Application No. 201180015721.4 (together with English language translation).

* cited by examiner

MICROPHONE

TECHNICAL FIELD

The present invention relates to a microphone structured to be capable of canceling vibration noise caused by mechanical vibration.

BACKGROUND ART

FIG. 1 shows a structure described in Patent literature 1 as a conventional example of this type of microphone.

In this example, two electret condenser microphone units are disposed in a holder 1. In FIG. 1, the microphone units have diaphragms 2*a* and 2*b*, and opposite electrodes (back plates) 3*a* and 3*b* are respectively disposed opposite to the diaphragms 2*a* and 2*b*. The opposite electrodes 3*a* and 3*b* are connected to the gate terminal of a field effect transistor (FET) 4.

The opposite electrodes 3*a* and 3*b* and the FET 4 are supported by a supporting member 5, and the opposite electrodes 3*a* and 3*b* are disposed opposite each other with the FET 4 placed therebetween. The diaphragms 2*a* and 2*b* are positioned at the outer sides of the opposite electrodes 3*a* and 3*b*, respectively.

The holder 1 has a through hole 6 and also has a narrow gap 7*e* between the supporting member 5 and the inner wall of the holder 1. Ring-shaped members 8*a* and 8*b* provided at the outer sides of the diaphragms 2*a* and 2*b* in order to form outer cavities 7*a* and 7*b* are cut to form paths 7*c* and 7*d*, respectively.

Sound waves input from the through hole 6 pass through the narrow gap 7*e*, the paths 7*c* and 7*d*, and the outer cavities 7*a* and 7*b* to reach the diaphragms 2*a* and 2*b*. Independent inner cavities 9*a* and 9*b*, not connecting with each other, are formed between the opposite electrodes 3*a* and 3*b*.

With this structure, in-phase output signals can be obtained from the two microphone units for the input sound waves, whereas opposite-phase outputs can be obtained for vibration noise caused by mechanical vibration, allowing the vibration noise to be canceled.

PRIOR ART LITERATURE

Patent Literature

[Patent literature 1] Japanese Patent Application Laid-Open No. 02-41099 (Japanese Registered Patent No. 2748417)

SUMMARY OF THE INVENTION

Problems to be Solved by the Invention

In the microphone structured as described above, the two diaphragms 2*a* and 2*b* are disposed at both ends of the microphone; in other words, the two diaphragms 2*a* and 2*b* are disposed far apart. Therefore, when the vibration source is located beside a side wall (the left or right) of the holder 1, for example, the difference $\Delta L_1$ in distance from the vibration source to the two diaphragms 2*a* and 2*b* is large, which is a disadvantage in canceling the vibration noise caused by the mechanical vibration.

Accordingly, an object of the present invention is to provide a microphone having a high vibration-noise canceling effect by making the distance between two diaphragms very small.

Means to Solve the Problems

According to the present invention, a microphone capable of canceling vibration noise caused by mechanical vibration includes a pair of diaphragms and a pair of back plates opposite the respective diaphragms in a capsule; a printed circuit board is disposed at the middle of the capsule; and the pair of diaphragms are disposed close and opposite to the surfaces of the printed circuit board, respectively, with the printed circuit board disposed therebetween.

Effects of the Invention

According to the present invention, the distance between the two diaphragms is made very small, which makes the difference in distance from the vibration source to the two diaphragms small. Therefore, a high canceling effect is obtained with respect to vibration noise caused by mechanical vibration.

DETAILED DESCRIPTION OF THE EMBODIMENTS

Embodiments of the present invention will be described below.

Figure 2A:
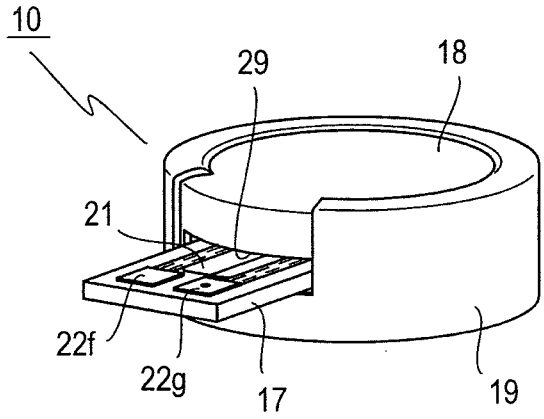
FIG. 2A is a perspective view of the appearance of a microphone according to an embodiment of the present invention, seen from an upper side.
Figure 2B:
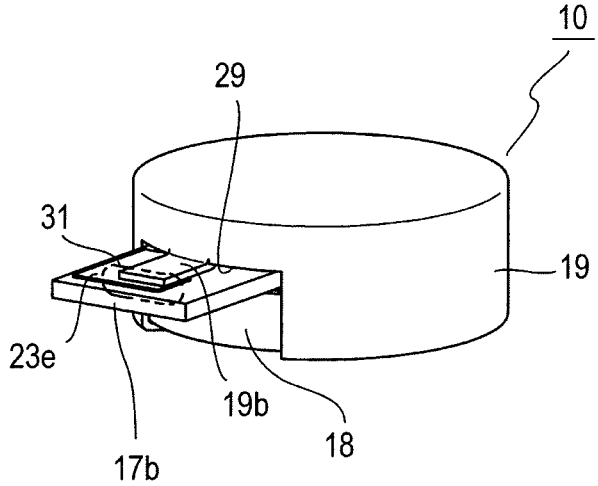
FIG. 2B is a perspective view of the microphone shown in FIG. 2A, seen from a lower side.
Figure 3:
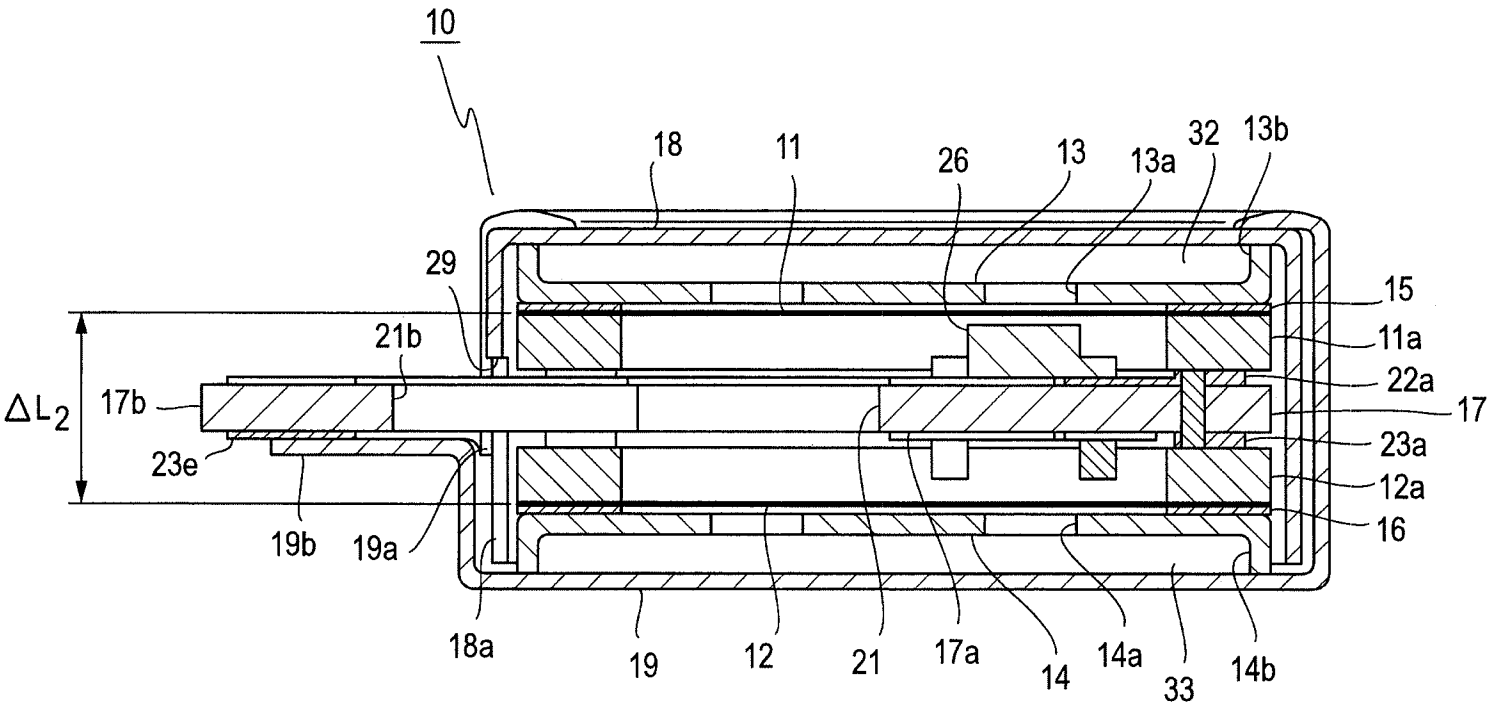
FIG. 3 is a cross sectional view of the microphone shown in FIGS. 2A and 2B.
Figure 4:
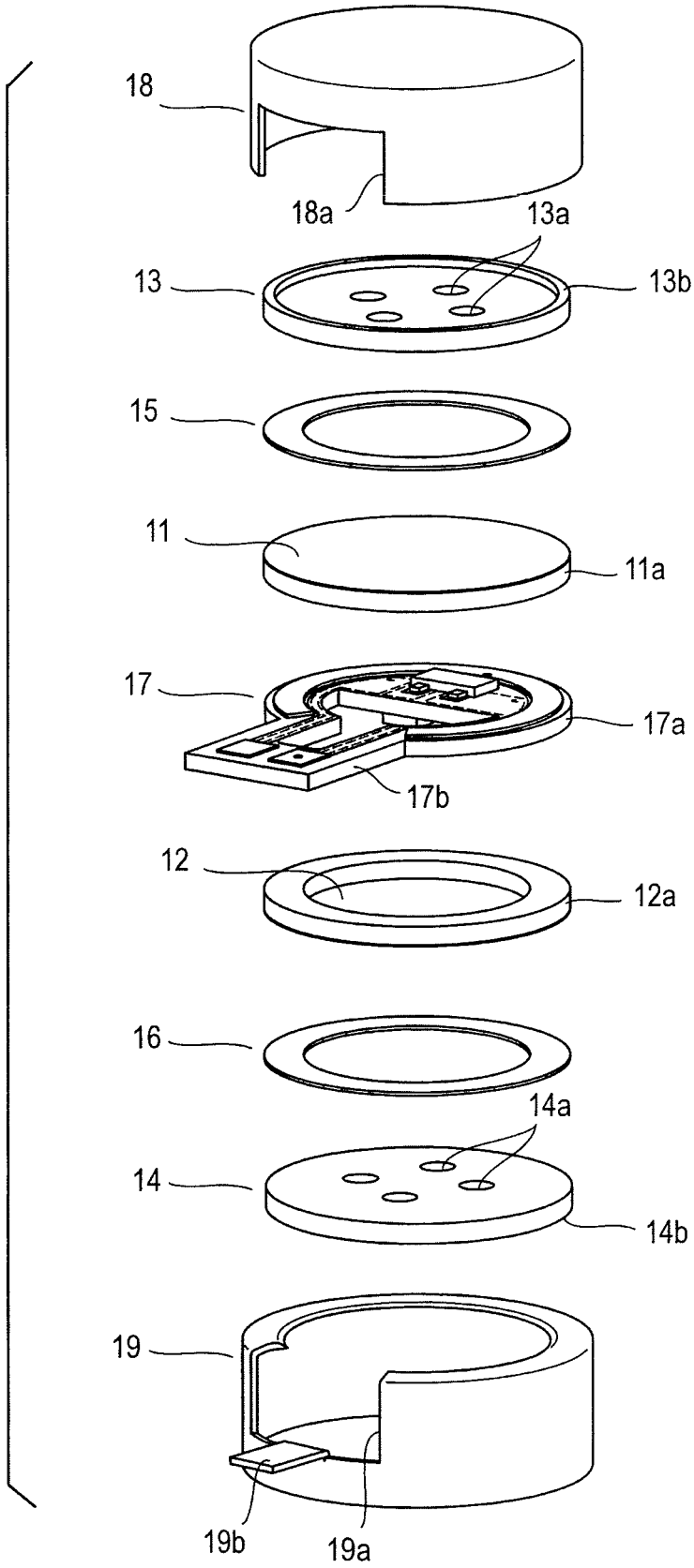
FIG. 4 is an exploded perspective view of the microphone shown in FIGS. 2A and 2B.

FIGS. 2A and 2B show the appearance of a microphone according to an embodiment of the present invention. FIG. 3 shows the cross sectional structure thereof. FIG. 4 shows an exploded view thereof. In this embodiment, a microphone 10 is formed of a pair of diaphragms 11 and 12 glued to and supported by rings 11*a* and 12*a*, a pair of back plates 13 and 14, a pair of spacers 15 and 16, a printed circuit board 17 on which predetermined patterns are formed and components are mounted, and a capsule for accommodating the above.

In this embodiment, the capsule is divided into two upper and lower capsules 18 and 19, and these capsules 18 and 19 are cylinders with one end face closed, as shown in FIG. 4.

The capsule 18 is cut from an open end face at a cylindrical wall to form an opening 18*a*. In the same way, the capsule 19 is cut from an open end face at a cylindrical wall to form an opening 19*a*. A protruding piece 19*b* is bent from the capsule 19 at an inner end (close to the closed end face) of the opening 19*a* so as to protrude toward the outside.

The capsule 18 is slightly smaller in diameter than the capsule 19, so that the capsule 18 can be put inside the capsule 19. FIG. 4 shows a state in which the open end face of the capsule 19 is crimped in assembly, which will be described later.

The pair of back plates 13 and 14 are circular and have four through holes 13*a* and 14*a* on their plate faces, respectively. In this embodiment, the back plates 13 and 14 have peripheral walls 13*b* and 14*b* having a predetermined height at their circumferences, respectively. The back plates 13 and 14 having the peripheral walls 13*b* and 14*b* can be formed, for example, by drawing. Electrets are formed on the faces of the back plates 13 and 14, which oppose the diaphragms 11 and 12, but they are not shown in the drawings.

The spacers 15 and 16 are made from an insulating material and are ring shaped in the same way as the rings 11*a* and 12*a*, which support the diaphragms 11 and 12.

Figure 5B:
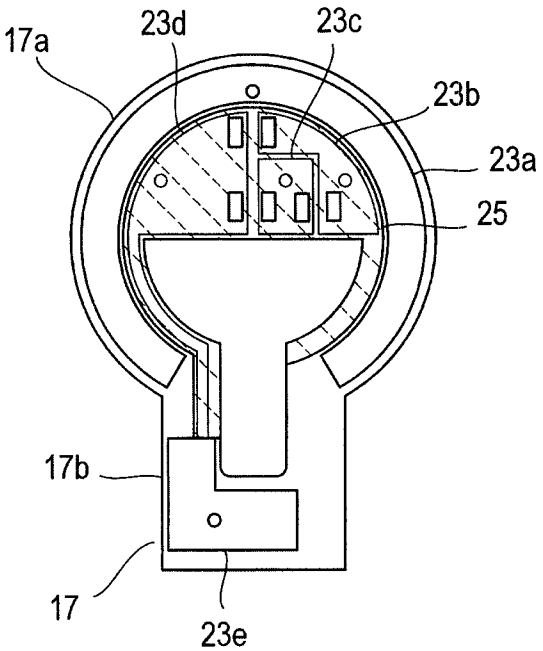
FIG. 5B is a view showing pattern details on the printed circuit board, seen from a lower side.
Figure 5A:
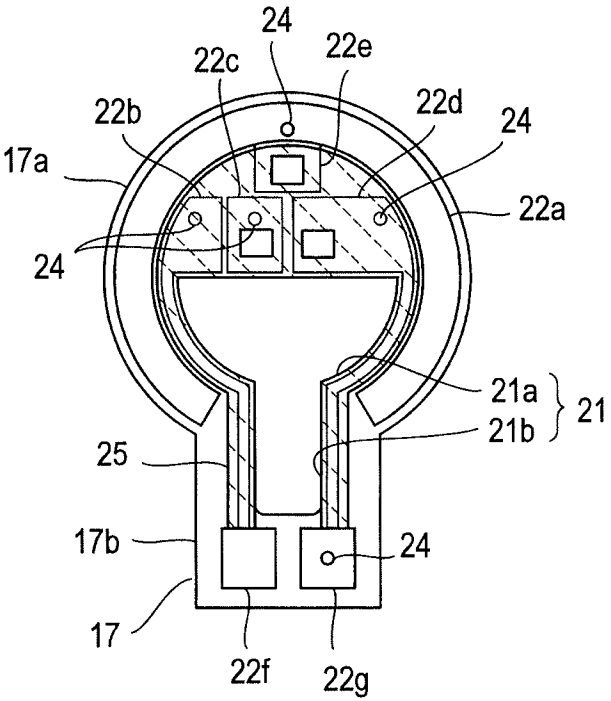
FIG. 5A is a view showing pattern details on a printed circuit board, seen from an upper side.

The printed circuit board 17 is formed of a circular part 17*a* and a rectangular protruding part 17*b* protruding from a part of the circumference of the circular part 17*a*. FIGS. 5A and 5B show details of the printed circuit board 17. The printed circuit board 17 has a large opening 21 from the protruding part 17*b* to the center of the circular part 17*a*. The opening 21 has a semi-circular part 21*a* concentric with the circular part 17*a* in the circular part 17*a*, and an extending part 21*b* extending from the semi-circular part 21*a* to the protruding part 17*b*.

As shown in FIG. 5A, an arc-shaped pattern 22*a* concentric with the circular part 17*a* and three island-shaped patterns 22*b*, 22*c*, and 22*d* are formed on the upper surface of the circular part 17*a* of the printed circuit board 17. A pattern 22*e* is formed at the center of the circumference of the arc-shaped pattern 22*a* in a protruding manner toward the center of the circular part 17*a*. Terminals 22*f* and 22*g* connected to the patterns 22*b* and 22*d*, respectively, are formed on the upper surface of the protruding part 17*b*.

As shown in FIG. 5B, an arc-shaped pattern 23*a* and three island-shaped patterns 23*b*, 23*c*, and 23*d* are formed on the lower surface of the circular part 17*a* in the same manner as on the upper surface. A pattern 23*e* connected to the pattern 23*d* is formed on the lower surface of the protruding part 17*b*. The patterns 22*a* and 23*a*, the patterns 22*b* and 23*b*, the patterns 22*c* and 23*c*, the patterns 22*d* and 23*d*, and the terminal 22*g* and the pattern 23*e* are electrically connected to each other via through holes 24. In FIGS. 5A and 5B, hatched portions with broken lines indicate areas coated with resist 25.

Figure 6B:
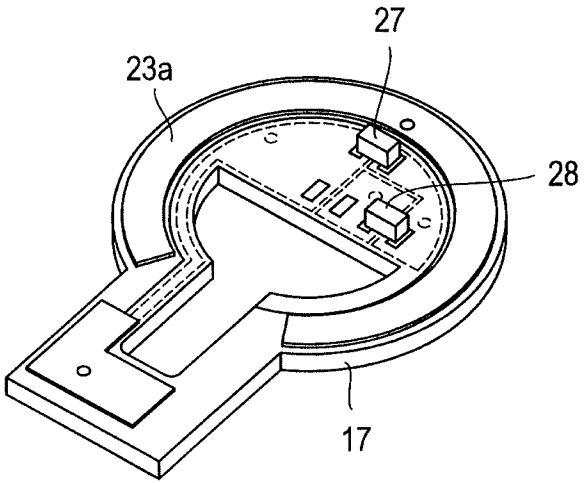
FIG. 6B is a perspective view showing the printed circuit board with components mounted thereon, seen from a lower side.
Figure 6A:
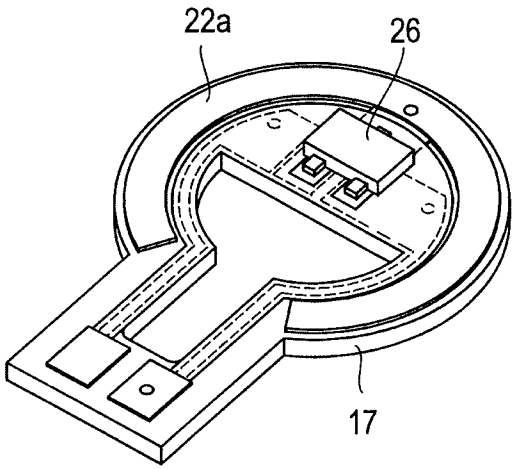
FIG. 6A is a perspective view showing the printed circuit board with a component mounted thereon, seen from an upper side.

FIGS. 6A and 6B show the printed circuit board 17 structured in the foregoing manner with components mounted thereon. An FET 26 is mounted on the upper surface of the printed circuit board 17, as shown in FIG. 6A, and a capacitor 27 and a resistor 28 are mounted on the lower surface of the printed circuit board 17, as shown in FIG. 6B.

The assembly of the microphone 10 will be described next.

The back plate 13, the spacer 15, the ring 11*a* supporting the diaphragm 11, the printed circuit board 17 with the components mounted thereon, the ring 12*a* supporting the diaphragm 12, the spacer 16, and the back plate 14 are sequentially put into the capsule 18 in stacked manner, then the capsule 18 is covered with the capsule 19, and the open end of the capsule 19 is crimped to assemble the microphone 10.

When assembling the microphone 10, the openings 18*a* and 19*a* of the capsules 18 and 19 are positioned at the same location, and the protruding part 17*b* of the printed circuit board 17 protrudes toward the outside of the capsules 18 and 19 from an opening 29 formed when the openings 18*a* and 19*a* are positioned. The protruding piece 19*b* of the capsule 19 is disposed so as to face and contact the lower surface of the protruding part 17*b* of the printed circuit board 17, and the protruding piece 19*b* is connected to the pattern 23*e* formed on the protruding part 17*b* by soldering to complete the microphone 10, as shown in FIGS. 2A, 2B, and 3. In FIG. 2B, a two-dot chain line shows an area where solder 31 is applied.

The pair of diaphragms 11 and 12 face the back plates 13 and 14 with the spacers 15 and 16 placed therebetween, respectively, and the pair of diaphragms 11 and 12 are disposed so as to be close and opposite to the surfaces of the printed circuit board 17 with the printed circuit board 17 placed therebetween.

The rings 11*a* and 12*a* respectively supporting the diaphragms 11 and 12 face and contact the patterns 22*a* and 23*a* of the printed circuit board 17, respectively, so that the pair of diaphragms 11 and 12 are connected to the gate terminal of the FET 26.

The extending part 21*b* of the opening 21 of the printed circuit board 17 is partially exposed to the outside. In this embodiment, sound waves are input to the capsules 18 and 19 through the opening 21 of the printed circuit board 17 and are transmitted to the diaphragms 11 and 12.

Since the diaphragms 11 and 12 are disposed very close to the printed circuit board 17 and the printed circuit board 17 serves as a sound inlet in the way described above, the back plates 13 and 14 serve as back chambers that support the stiffness of the diaphragms 11 and 12. In this embodiment, the peripheral walls 13*b* and 14*b* are provided for the back plates 13 and 14, respectively, by drawing, and spaces surrounded by the peripheral walls 13*b* and 14*b* are covered with the closed end faces of the capsules 18 and 19 to form back chambers 32 and 33. With this structure, the back chambers 32 and 33 can be easily formed without using any other members.

Figure 1:
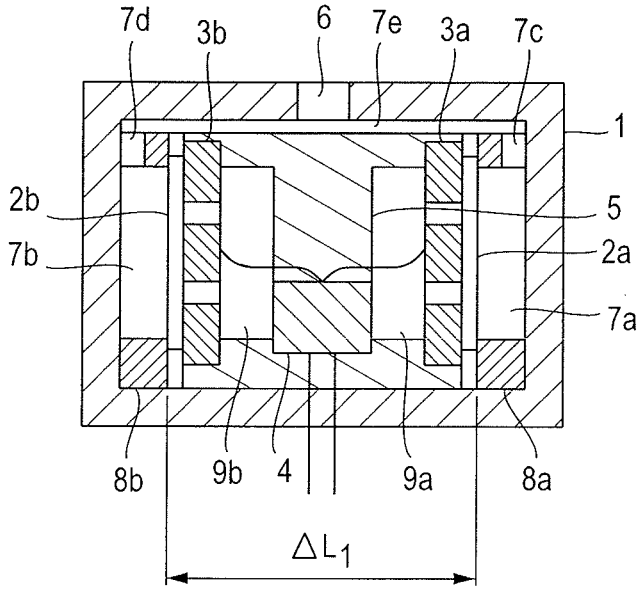
FIG. 1 PRIOR ART
FIG. 1 is a cross sectional view showing the structure of a conventional microphone.

According to the microphone 10 structured as described above, the pair of diaphragms 11 and 12 are provided to allow in-phase output signals to be generated for input sound waves and opposite-phase outputs to be generated for vibration noise caused by mechanical vibration, so that the vibration noise can be canceled. Since the pair of diaphragms 11 and 12 are disposed so as to be close to and face each other with the printed circuit board 17 placed therebetween, the difference $\Delta L_2$ in distance from the vibration source to the two diaphragms 11 and 12 is made much smaller in this embodiment compared with that for the conventional microphone shown in FIG. 1. Therefore, the microphone 10 has a higher vibration-noise canceling effect than the conventional microphone.

In this embodiment, since sound waves are input to the microphone 10 from the opening 21 of the printed circuit board 17, the sound waves can be guided to the upper and lower vibration systems (the pair of diaphragms 11 and 12) uniformly. In addition, in this embodiment, since the rings 11*a* and 12*a* respectively supporting the diaphragms 11 and 12 directly face and contact the patterns 22*a* and 23*a* of the printed circuit board 17, respectively, in other words, since the rings 11*a* and 12*a* for the diaphragms 11 and 12 also serve as the gate ring of the FET 26, the structure is made simpler, the stray capacitance around the gate of the FET 26 is reduced, and a high output is possible.

Figure 7A:
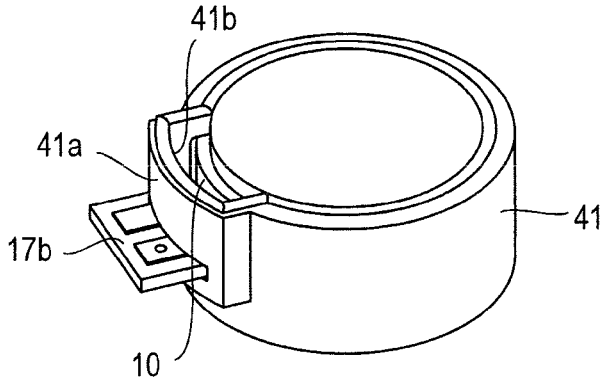
FIG. 7A is a perspective view of the microphone shown in FIGS. 2A and 2B with a holder mounted thereon, seen from an upper side.
Figure 7B:
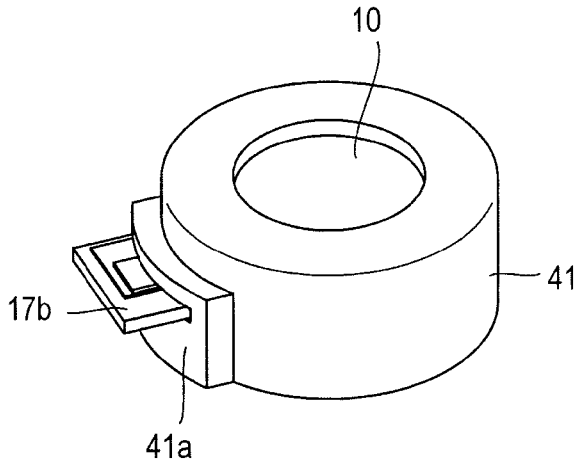
FIG. 7B is a perspective view of the microphone shown in FIGS. 2A and 2B with the holder mounted thereon, seen from a lower side.
Figure 7C:
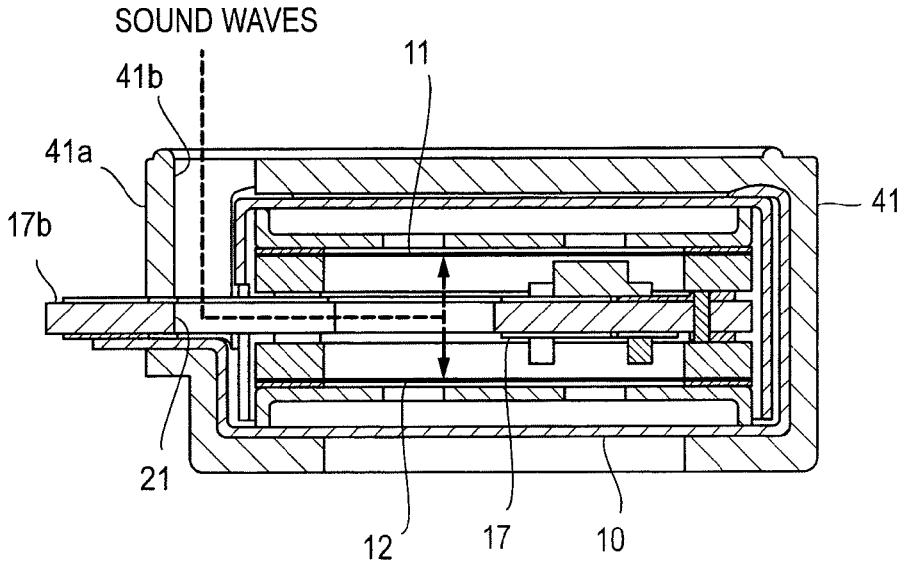
FIG. 7C is a cross sectional view of the microphone shown in FIGS. 2A and 2B with the holder mounted thereon.

When the microphone 10 is mounted in an electronic device, the terminals 22*f* and 22*g* formed on the protruding part 17*b* of the printed circuit board 17 are connected to terminals on a printed circuit board of the electronic device with lead wires. Usually, the microphone 10 is placed in a rubber holder before being mounted. FIGS. 7A, 7B, and 7C show the microphone 10 to which a holder 41 is attached.

The holder 41 has a protruding part 41*a* corresponding to the protruding part 17*b* of the printed circuit board 17. The protruding part 41*a* has an opening 41*b* connected to the opening 21 of the printed circuit board 17.

Figure 8:
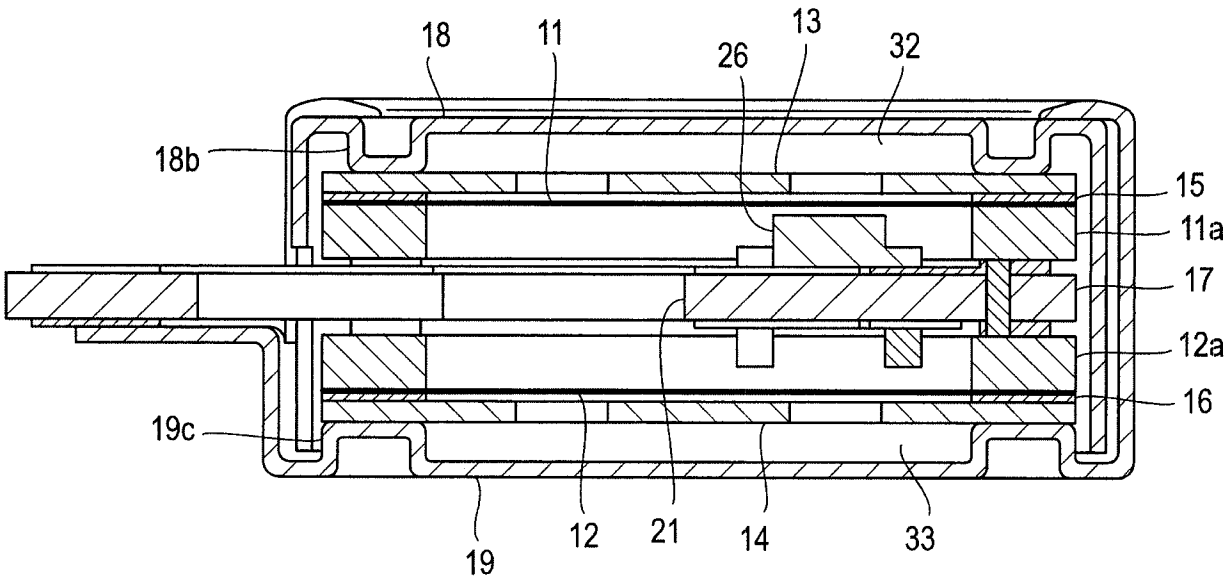
FIG. 8 is a cross sectional view of a microphone according to another embodiment of the present invention.

FIG. 8 shows a microphone according to another embodiment of the present invention. Unlike in the foregoing embodiment, in which the back plates 13 and 14 are provided with the peripheral walls 13*b* and 14*b* to form the back chambers 32 and 33, in this embodiment, the closed end faces of the capsules 18 and 19 are made to have gutters, as shown in FIG. 8; in other words, projections 18*b* and 19*c* protruding inward are formed in the circumference at peripheral portions of the closed end faces of the capsules 18 and 19, respectively, to make back chambers 32 and 33. The back plates 13 and 14 are simple circular plates. Spaces surrounded by the projections 18*b* and 19*c* are covered with the back plates 13 and 14 to form the back chambers 32 and 33. Such a structure can be employed.

Figure 9:
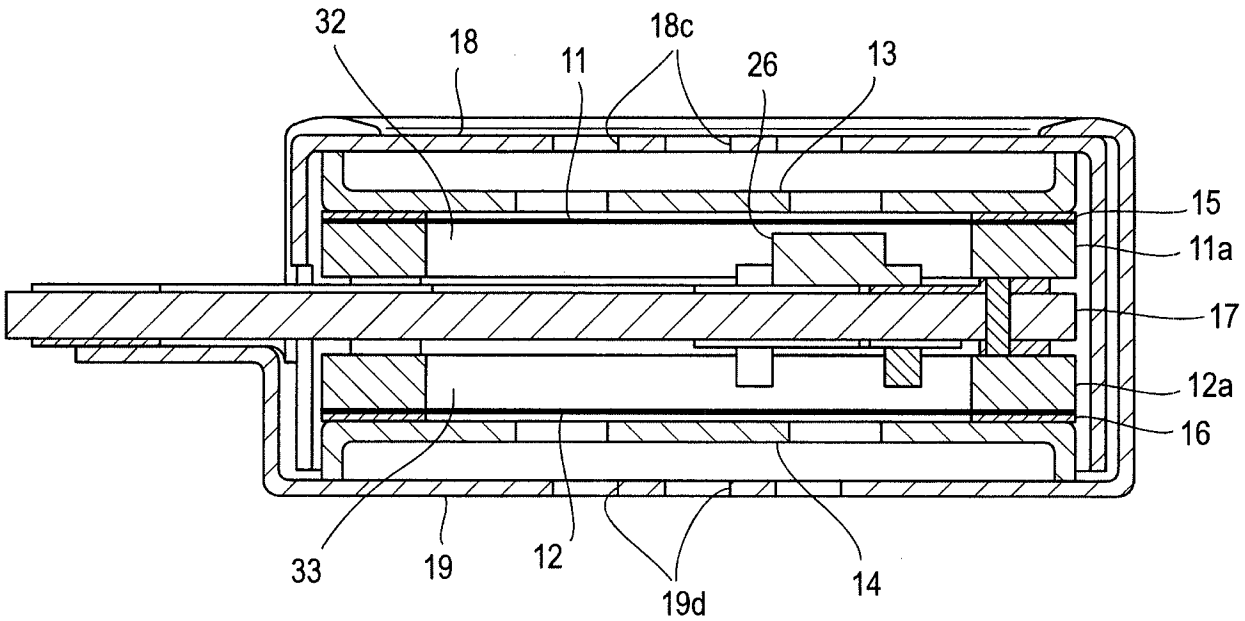
FIG. 9 is a cross sectional view of a microphone according to a modification of the present invention.

In the above-described embodiments, sound waves are input to the microphone from the opening 21 of the printed circuit board 17; in other words, sound waves are input from a side of the microphone. Instead of that structure, another structure may be used in which sound holes 18*c* and 19*d* are formed in the closed end faces of the capsules 18 and 19, as shown in FIG. 9, so that sound waves are input from the upper and lower directions of the microphone. In that case, the printed circuit board 17 does not have the opening 21, and the back chambers 32 and 33 are formed between the printed circuit board 17 and the diaphragms 11 and 12.

INDUSTRIAL APPLICABILITY

A microphone according to the present invention is effective when used as a vibration canceling microphone for canceling zooming sounds in a digital video camera (DVC) or a digital still camera (DSC), and can be applied, for example, to a device that requires countermeasures for vibration such as noise caused by touch.

What is claimed is:

1. A microphone capable of canceling vibration noise caused by mechanical vibration, comprising in a capsule:

a pair of diaphragms;

a pair of back plates opposite to the respective diaphragms; and a printed circuit board being disposed at the middle of the capsule, wherein the pair of diaphragms being disposed close and opposite to the surfaces of the printed circuit board, respectively, with the printed circuit board disposed therebetween, wherein the printed circuit board has a protruding part protruding toward the outside of the capsule, and the printed circuit board has an opening, a part of which is located at the protruding part; and sound waves are input to the capsule through the opening.

2. The microphone according to claim 1, wherein the printed circuit board has a circular part accommodated in the capsule and the protruding part, which protrudes from a part of the circumference of the circular part, and the opening extends to the center of the circular part.

3. The microphone according to claim 2, wherein the pair of diaphragms are respectively glued to and supported by rings; and the rings face and contact the printed circuit board.

4. The microphone according to claim 2, wherein the back plates have peripheral walls and spaces surrounded by the peripheral walls are covered by end faces of the capsule to form back chambers.

5. The microphone according to claim 2, wherein projections protruding inward are formed in a circumference at peripheral portions of end faces of the capsule, and spaces surrounded by the projections are covered by the back plates to form back chambers.

6. The microphone according to claim 1, wherein the protruding part protrudes toward the outside of the capsule from an opening of the capsule, and a protruding piece is formed at the opening of the capsule to face and contact the protruding part.

7. The microphone according to claim 6, wherein the pair of diaphragms are respectively glued to and supported by rings; and the rings face and contact the printed circuit board.

8. The microphone according to claim 6, wherein the back plates have peripheral walls and spaces surrounded by the peripheral walls are covered by end faces of the capsule to form back chambers.

9. The microphone according to claim 6, wherein projections protruding inward are formed in a circumference at peripheral portions of end faces of the capsule, and spaces surrounded by the projections are covered by the back plates to form back chambers.

10. The microphone according to claim 1, wherein an external-connection terminal is formed at the protruding part.

11. The microphone according to claim 10, wherein the pair of diaphragms are respectively glued to and supported by rings; and the rings face and contact the printed circuit board.

12. The microphone according to claim 10, wherein the back plates have peripheral walls and spaces surrounded by the peripheral walls are covered by end faces of the capsule to form back chambers.

13. The microphone according to claim 10, wherein projections protruding inward are formed in a circumference at peripheral portions of end faces of the capsule, and spaces surrounded by the projections are covered by the back plates to form back chambers.

14. The microphone according to claim 1, wherein the pair of diaphragms are respectively glued to and supported by rings; and the rings face and contact the printed circuit board.

15. The microphone according to claim 1, wherein the back plates have peripheral walls and spaces surrounded by the peripheral walls are covered by end faces of the capsule to form back chambers.

16. The microphone according to claim 1, wherein projections protruding inward are formed in a circumference at peripheral portions of end faces of the capsule, and spaces surrounded by the projections are covered by the back plates to form back chambers.

* * * * *